US005833234A

United States Patent [19]

Vavala et al.

[11] Patent Number: 5,833,234

[45] Date of Patent: Nov. 10, 1998

[54] REBOUNDING APPARATUS

[76] Inventors: Ralph J. Vavala, 28 Hirsch Rd.; Tzuu-Hong Bernard Fu, 58 Old North Stamford Rd., both of Stamford, Conn. 06905

[21] Appl. No.: 453,977

[22] Filed: May 30, 1995

[51] Int. Cl.[6] ..... A63B 69/40

[52] U.S. Cl. ..... 273/26 A; 273/400; 273/410

[58] Field of Search ..... 273/26 A, 29 R, 273/30, 410, 411, 400

[56] References Cited

U.S. PATENT DOCUMENTS

| | | | |
|---|---|---|---|
| 3,427,026 | 2/1969 | Mahoney | 273/26 A |
| 3,706,451 | 12/1972 | Dixon | 273/26 A |
| 4,553,751 | 11/1985 | Ketchim | 273/26 A |
| 4,905,996 | 3/1990 | Tallent | 273/26 A |
| 5,333,856 | 8/1994 | Gery | 273/26 A |
| 5,407,711 | 4/1995 | Bottiglieri | 273/26 A |

*Primary Examiner*—Theatrice Brown
*Attorney, Agent, or Firm*—Rodger H. Flagg

[57] ABSTRACT

A rebound apparatus used to deflect a thrown ball back in the general direction from which the ball was thrown. The fabric support frame angle is adjustably positioned and the polymeric woven fabric supported by the fabric support frame is adjustably tensioned to provide the desired rebound angle and distance, to simulate ground balls, line drives and fly balls. The fabric support frame has lower brackets which are pivotally secured to the distal ends of a U-shaped brace member. Upper brackets on the fabric support frame pivotally secure telescoping members on one end, with the other end releasably secured to a selected aperture on the U-shaped brace member. Bottom portions of the fabric support frame and the telescoping members provide ground engaging feet to support the rebound apparatus during use. The U-shaped brace member may be folded substantially parallel with the fabric support frame, and the telescoping members releasably secured in aligned apertures in the U-shaped brace member, for ease of transport and storage. Indicia, such as a target may be releasably secured to the woven fabric, and at least one wheel may be rotatably secured to the fabric support frame, for ease of transport.

20 Claims, 3 Drawing Sheets

REBOUNDING APPARATUS

BACKGROUND OF THE INVENTION

This invention relates to rebounding apparatus used to deflect a thrown ball back in the general direction from which the ball was tossed or thrown. The frame angle is adjustably positioned to provide many different types of rebounds such as a fly ball, a grounder, or a line drive. The panel is adjustably tensioned to provide the desired rebound angle and distance.

There is no mention of using woven fabrics as a rebounding panel in the prior art. The prior art related to rebound apparatus use only nets to rebound the balls. The nets serve the purpose of stopping the ball with a certain degree of rebounding capability. However, the direction, the height, and the distance of travel of the rebounded balls are less predictable.

The following prior art reveals the use of net-like material for rebounding balls:

U.S. Pat. No. 4,553,751 describes an angularly adjustable rebound apparatus using a flexible, resilient screen. The patent describes a two-frame design with a face screen connected to a back frame by springs. The purpose of the spring is to absorb the impact of the ball striking the front screen, in order to avoid the movement of the base frame, but does not disclose a means to adjust the screen tension. The angle of the frame is adjusted by swiveling the back frame from rods connecting the lower corners of the back frame and the side base arms, while the upper corners are pivotally connected to the fixed triangular supporting frames.

U.S. Pat. No. 2,944,816 describes a net connected to a frame with elastic members. The angles of the frame can be adjusted by changing the position of the supporting rod on a base board. The tension of the net is adjusted by a number of connecting elastic members such as rubber bands. To avoid movement of the device, the frame is secured by stakes.

U.S. Pat. No. 3,836,144 discloses a net connected to a support frame by resilient strap members. The support frame is connected by two side tubes to the supporting base frame.

U.S. Pat. No. 3,427,026 discloses a net supported by a frame which is adjustably positioned by two sets of telescoping tubes, one in the front and one in the back.

U.S. Pat. No. 4,703,931 discloses a cage-like structure using net material connected to a three dimensional frame.

U.S. Pat. No. 3,711,092 discloses a ball rebound means in which the net is secured to a frame, with a length of cord.

SUMMARY OF THE INVENTION

The present invention uses a high strength, high modulus polymeric woven fabric material of six to ten oz. weight per square yard, with a fabric count of at least 40×30 strands per square inch, a finished square yard weight of at least six ounces per square yard, and a grab tensile strength of at least 400×300 pounds, as a rebound panel.

The tension of the panel is adjusted by increasing or decreasing the tension applied to coil springs that are connected to the frame. The frame angle is adjusted by first and second telescoping members which are adjustably and releasably secured between the upper bracket on the fabric support frame and a selected spaced aperture on the first and second brace sides of the U-shaped brace member. These adjustably positioned telescoping members serve as positioning and support members for adjusting the angle of the fabric support frame in relation to the ground.

This invention can provide rebounds from balls, such as a baseball, a softball, or a tennis ball, by adjusting the tension of the high strength, high modulus woven fabric and also by changing the angular positions of the panel. The tension in the side panel can be adjusted to achieve the desired rebound distance, using a tightening means connected to the springs to increase or decrease the tension of the coil springs. The tension of the woven fabric panel determines the rebound force, and thus the distance of the rebound ball. The angles of the panel are adjusted through two adjustable, telescoping, supporting tubes and through the various adjustable positions on the side base frames for the two supporting tubes. In baseball or softball pitching, the adjustable angle of the woven fabric in relation to the ground, provides the return ball with many different types of rebounds. The rebound balls act substantially the same way as balls hit by a batter, to imitate fly balls, grounders, or line drives. This is achieved by changing the angle of the fabric support frame in relation to the ground, using the adjustably and releasably secured telescoping members. The four legs extending below the U-shaped brace member significantly reduce the possibility of accidentally tilting over during use, which may occur in the prior art designs.

This rebound apparatus may be used by anyone who practices alone to improve their skills in any of several sports that normally need a partner to return the ball to the player. Such sports are, for example, baseball, softball, lacrosse and tennis.

Other objects and features of the present invention will become apparent from a consideration of the following description which proceeds with reference to the accompanying drawings, wherein example embodiments of the invention are selected by way of illustration and not by way of restriction.

BRIEF DESCRIPTION OF THE DRAWINGS

The above mentioned and other features and objects of this invention and the manner of attaining them will become more apparent and the invention itself will be best understood by reference to the following description of the invention, when considered in conjunction with the accompanying drawings, wherein.

DESCRIPTION OF THE PREFERRED EMBODIMENT

Figure 1:
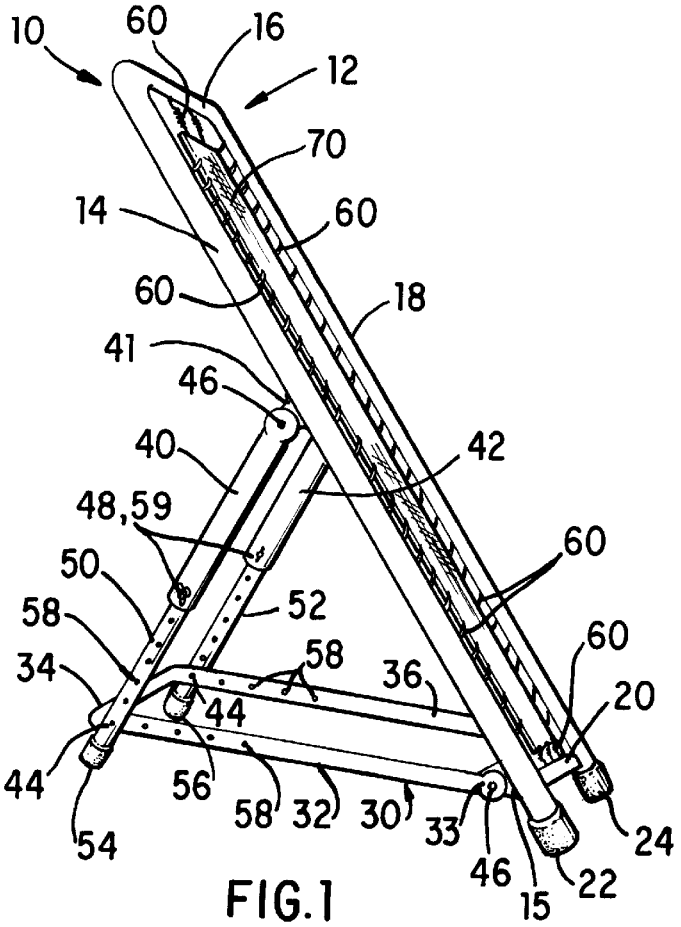
FIG. 1 is a perspective side view of the rebound apparatus.
Figure 2:
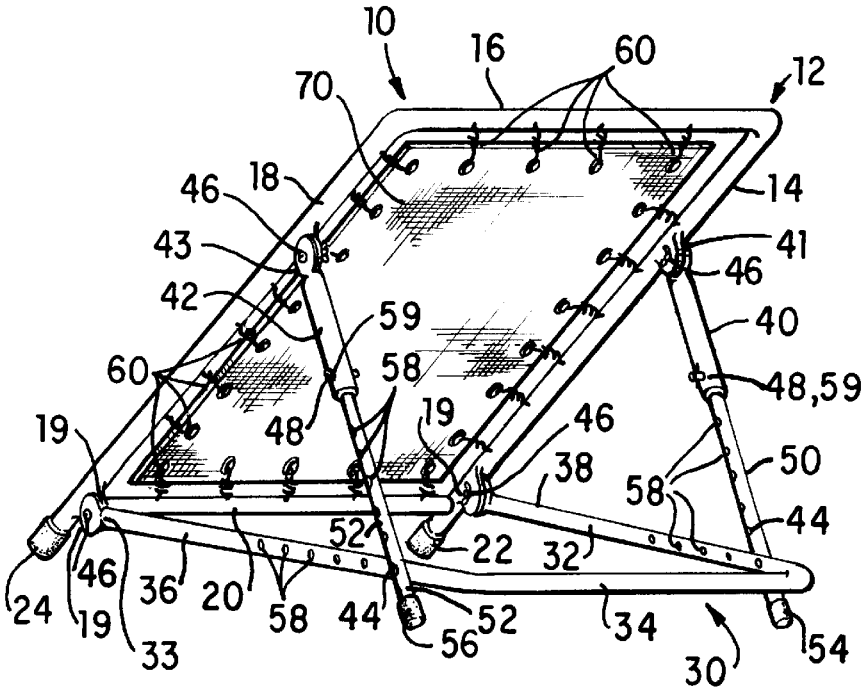
FIG. 2 is a perspective rear view of the rebound apparatus.

FIG. 1 is a perspective side view of the rebound apparatus 10. Likewise, FIG. 2 is a perspective rear view of the rebound apparatus 10. As shown in FIG. 1 and FIG. 2, a fabric support frame 12 comprises an inverted U-shaped frame structure having a first frame side 14, a top frame side 16, a second frame side 18 and a bottom frame side 20. The end portion 22 of the first frame side 14 and the end portion 24 of the second frame side 18 each extend below the bottom frame side 20 to support the fabric support frame 12 upon the ground or floor (not shown).

A generally U-shaped brace member 30 has a first brace side 32, a back brace side 34, and a second brace side 36. The end 33 of the first brace side 32 is secured to a first lower bracket 15 with a pivoting connection means 46. Likewise, the end 37 of the second brace side 36 is secured to a second lower bracket 19 with a pivoting connection means 46. The first and second lower brackets 15, 19 are preferably secured to respective first and second frame sides 14, 18 from one to seven inches from the respective first and second end portions 22, 24 of the fabric support frame 12.

A first outer telescoping member 40 is secured to a first upper bracket 41 with a pivoting connection means 46. The first upper bracket 41 is located on the first frame side 14. Preferably, the first upper bracket 41 is located closer to the top of the frame side 16, than to the first end portion 22, for increased stability. Likewise, a second outer telescoping member 42 is secured to a second upper bracket 43 with a pivoting connection means 46. The second upper bracket 43 is located on the second frame side 18. Preferably, the second upper bracket 43 is located closer to the top frame side 16 than to the second end portion 24, for increased stability.

The first outer telescoping member 40 slidably receives the first inner telescoping member 50 therein. The first inner telescoping member 50 is secured to the generally U-shaped brace member 30 with a releasable connection means 46. The first end support 54 of the first inner telescoping member 50 extends below the generally U-shaped brace member 30, to provide additional ground support. The first inner telescoping member is secured to the first outer telescoping member 50 by a releasable fastening means 48. The releasable fastening means 48 may be any known releasable fastening means, such as a T-bar, bolt, spring pin, clip, etc.

A plurality of spaced apertures 58 in the first inner telescoping member 50 align with at least one aperture 59 in the first outer telescoping member 40 to provide adjustable positioning of the fabric support frame 12, in relation to the ground or floor. Likewise, the second inner telescoping member 52 is secured to the second outer telescoping member 42 by a releasable fastening means 48. A plurality of spaced apertures 58 in the second inner telescoping member 52 align with at least one aperture 59 in the second outer telescoping member 42 to provide adjustable positioning of the fabric support frame 12, in relation to the ground or floor.

While the preferred embodiment is shown with the outer telescoping member 40 located above the inner telescoping member 50, it is well within the scope of this disclosure, to locate the outer telescoping member 40 below the inner telescoping member 50, and/or to provide a plurality of spaced apertures in either or both the inner and outer telescoping members 40, 50, to provide adjustable positioning of the fabric frame support 12 in relation to the ground. Other known adjustable means of securement of the inner and outer telescoping members are also considered to be within the scope of this disclosure, although not shown as they are well known to one of average skill in this art, and thus need not be further disclosed herein.

A plurality of spaced apertures 58 are provided in the first and second brace sides 32, 36, to provide an additional adjustment means. By way of example, the first and second inner telescoping members 50, 52 may be secured by respective releasable fastening means 44 to the farthest aperture 58 from brackets 15, 19 as shown in FIG. 1.

The first and second inner telescoping members 50, 52 may be selectively secured by a releasable fastening means 48 to an aperture located closer to brackets 15, 19, as shown in FIG. 2.

By selectively adjusting the combined lengths of the telescoping tubes 40, 50 and 42, 52 and the relative position of the telescoping tubes 40, 50 along the first and second brace sides 32, 36, the angle of the fabric support frame 12 may be selectively adjusted in relation to the ground to obtain a desirable rebound, such as a ground ball, a fly ball or a line drive. The tensioning of the fabric 70, serves to control the force of the rebound. In general, the higher the tension, the longer the rebounding distance.

The fabric support frame 12, the U-shaped brace member 30, and the first and second inner and outer telescoping members 40, 42 and 50, 52 may be made of conventional materials, such as aluminum or galvanized steel tubing, or of plastic tubing such as polyvinyl chloride (PVC). While the fabric support frame 12, the U-shaped brace member 30 could be made of rod, angle or channel materials, tubing is preferred for its light weight and strength.

Figure 3:
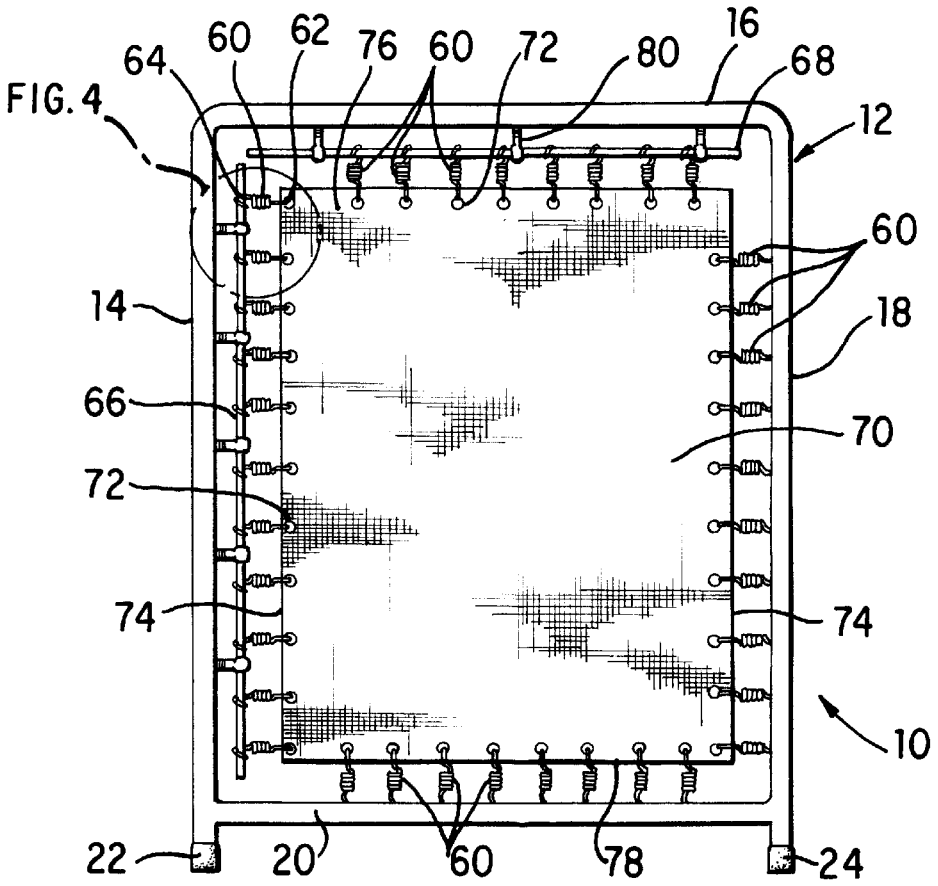
FIG. 3 is a front view of the rebound apparatus having first and second tensioning rods.
Figure 4:
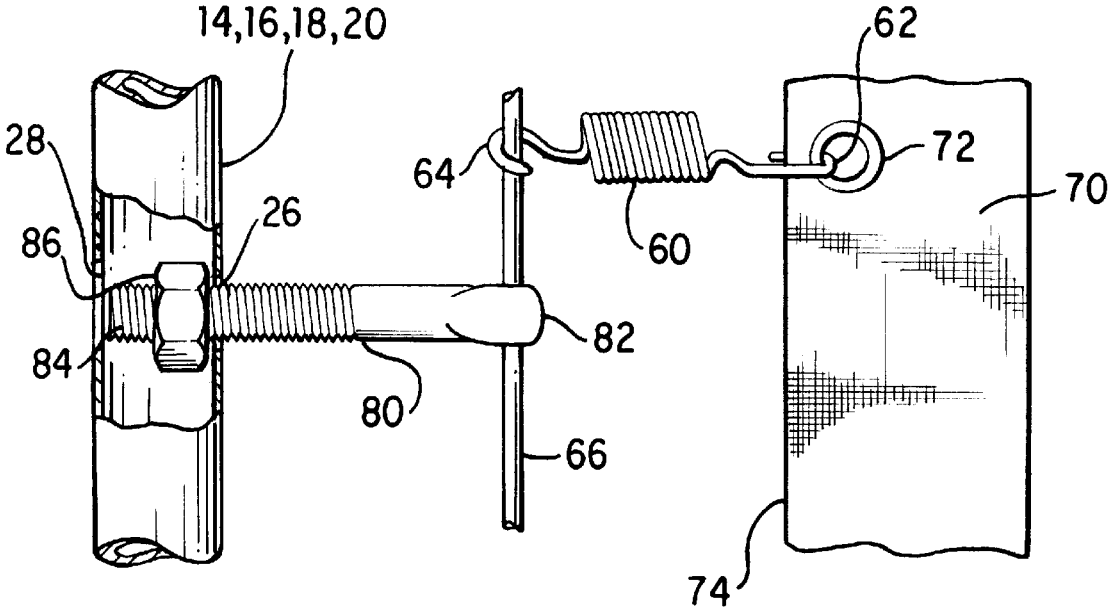
FIG. 4 is an enlarged view of the tensioning rods taken along lines 4—4 in FIG. 3.

As shown in FIG. 3 and FIG. 4, the fabric material 70 is stretched between the fabric support frame 12, preferably with a plurality of springs 60. The fabric end of spring 62 is preferably secured to a selected grommet 72 located about the outer periphery of the fabric 70 to resiliently support the woven fabric 70 between the fabric support frame 12. The frame end of spring 64 may be either supported within a selected aperture 26 as shown on the second side 18 of the fabric support frame 12, or the frame end of spring 64 may be secured to a first rod 66 as shown on the first side 14 of the fabric support frame 12. The first rod 66, is preferably adjustably secured to the first side 14 with a bolt 80 having a rod receiving end 82 and a threaded end 84. Likewise, a second rod 68 is preferably adjustably secured to the top side of the fabric support frame 16 with a bolt 80 having a rod receiving end 82 and a threaded end 84. The plurality of apertures 26 in the fabric support frame are preferably aligned in spaced relation with the grommets on the outer periphery of the woven fabric 70. Preferably, the grommets are spaced from one to six inches apart along the outer periphery of the woven fabric 70.

As best shown in FIG. 4, the selected aperture 26 in first side 14 and top side 16 is sized to provide a clearance hole for bolt 80. An enlarged aperture 28 in alignment with the selected aperture 26 is sized to receive a nut 86 threadably received upon the threaded end 84 of bolt 80. The enlarged aperture 28 is preferably further sized to also receive a socket for tightening and loosening nut 86 to adjustably tension the woven fabric 70 between fabric support frame 12. Alternately, other known fastening means, such as a screw cap (not shown) may be used in place of the nut 86, which would allow the screw cap to be tightened or loosened with a screw driver, or allen wrench.

Figure 5:
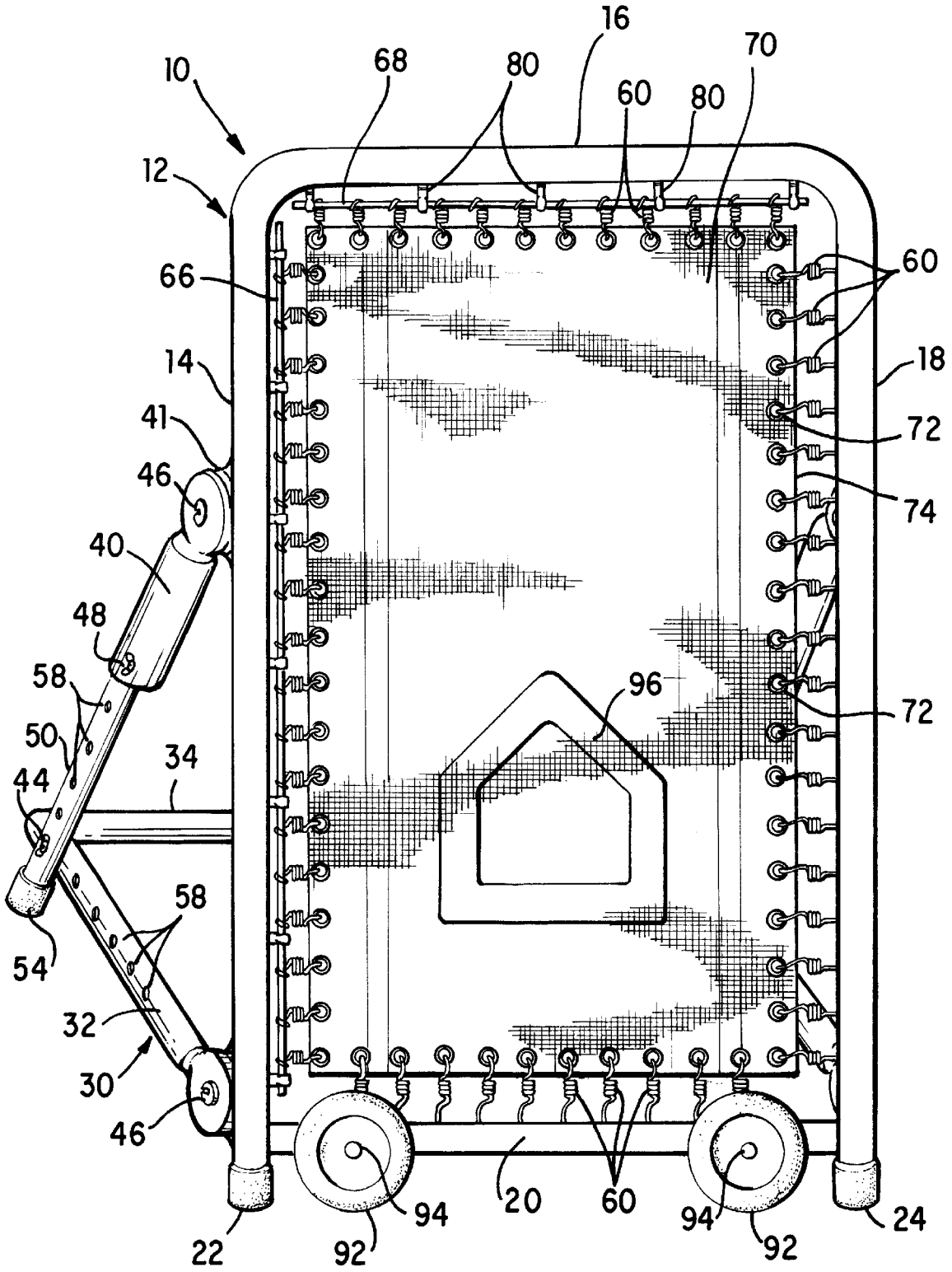
FIG. 5 is a front view of the rebound apparatus, with wheels and indicia attached.

Preferably, the number of bolts 80 secured to a selected rod 66 or 68 is less than the number of springs 60 secured to a selected rod 66 or 68. By way of example, FIG. 3 shows five bolts, and 11 springs secured to side rod 66. Alternately, by way of example, FIG. 5 shows 7 bolts and 19 springs secured to side rod 66. Springs are preferably positioned from one to six inches apart along the outer periphery of the woven fabric 70.

In this way, the woven fabric 70 may be adjustably tensioned with a few nuts and bolts, which act through a plurality of springs 60 secured to the woven fabric 70.

While it is within the scope of this invention to include tensioning rods 66, 68 on all four sides of the woven fabric 70, uniform tensioning may be achieved with one first rod 66 and one second rod 68, as shown in FIG. 3 and FIG. 5. Where tensioning first and second rods 66, 68 are not used, the frame end 64 of the plurality of springs 60 are secured directly to fabric support frame 12. Any conventional means of securement may be used to secure the frame end 64 of each of the plurality of springs 60 to the first side 14 and/or the second side 18, and to the top side 16 and/or bottom side 20 of the fabric support frame 12.

A selected aperture of a plurality of spaced apertures 26 in fabric support frame 12, are each sized to receive the frame end 64 of spring 60. The plurality of spaced apertures 26 may face the fabric 70, or may be placed at any convenient location on fabric support frame 12 for ease of installation or fabrication.

Woven fabric 70 is a high strength, high modulus polymer, such as polypropylene, polyester or polyamide. Preferably, the woven fabric exhibits a fabric count of at least 40 by 30 strands per square inch, having a finished weight of at least six ounces per square yard in weight, and having a grab tensile strength of at least 400 by 300 pounds. Most preferably, the woven fabric 70 is polypropylene woven fabric which has been tentered and calendared, with a fabric count of 60×50 strands per square inch, with a square yard weight of 7.9 ounces, and having a grab tensile strength of 475×415, such as product code 902880-4, No. 24119, commercially manufactured by Nicolon Corporation of Norcross, Ga.

A drop ball test was conducted on a prototype of this invention by applicants. A baseball with a weight of 6 ounces was dropped from six feet above the horizontal surface of fabric 70. The rebound height was measured with increasing tension applied on the fabric 70. The results showed that the percent rebound increased from approximately 25 to 70 percent with increasing tension. Higher rebound is expected if higher strength coil cprings are used.

The same test was compared to a commercially available product with a net and rubber band design. The mesh opening of the net was approximately two inches by two inches. Measuring the rebound of the net design was difficult due to the random rebound directions, in contrast to the predictable upward direction of the rebound of the present invention.

The rebound apparatus 10 disclosed herein, may be readily folded together for transport or storage. To fold rebound apparatus 10, simply remove the releasable fastening means 44 from the first and second inner telescoping means, 50, 52, and fold U-shaped brace 30 against fabric support frame 12. The releasable fastening means may then be reinserted in aligned apertures 58 to secure the telescoping members 40, 42 and 50, 52 to a selected aperture 58 in U-shaped member 30, in substantial parallel alignment with fabric support frame 12, for ease of transport and storage.

As shown in FIG. 5, at least one wheel may be secured to the bottom side 20 of the fabric support frame 12, for ease of moving the rebound apparatus 10.

Also shown in FIG. 5, indicia, such as an adjustably positioned target 96, logo, figure, number(s) or letter(s) may be releasably secured and positioned in a desired location upon woven fabric 70 with hook and loop type fasteners, (not shown) such as commercially made and sold under the trademark: VELCRO.

The ends 22, 24 of the fabric support frame 12 and the ends 54, 56 of the telescoping members 50, 52 may be capped with a suitable material such as plastic or rubber, to limit the penetration of the ends into soft soil, sand or grass. Capped ends 22, 24, 54, 56 also serve to protect gym floors from being scratched or marred during indoor use of this rebound apparatus 10.

Thus, while a preferred embodiment of the rebound apparatus has been fully described and disclosed, numerous modifications and adaptations will become apparent to one of ordinary skill in this art, and such adaptations and modifications are intended to be included within the scope of the following claims:

What is claimed is:

1. A rebound apparatus, comprising:

a) a fabric support frame having a first frame side, a top frame side, a second frame side and a bottom frame side, the first frame side having a first bottom portion extending below the bottom frame side, a first lower bracket and a first upper bracket secured to the first frame side, the second frame side having a second bottom portion extending below the bottom frame side in alignment with the first bottom portion, and a second lower bracket and a second upper bracket secured to the second frame side in alignment with respective said first lower bracket and said second upper bracket;

b) a generally U-shaped brace member having a first brace side, a back brace side, and a second brace side, the distal end of the first brace side being pivotally secured to the first bottom bracket on the first frame side, and the distal end of the second brace side being pivotally secured to the second bottom bracket on the second frame side;

c) an adjustably secured extending and contracting first telescoping member, one end portion of said first telescoping member pivotally secured to the first upper bracket on the first frame side and the other end portion of said first telescoping member adjustably positioned and releasably secured to a selected aperture on the first brace side of the generally U-shaped brace member, a bottom portion of the first telescoping member extending beneath the first brace side of the generally U-shaped brace member, and an adjustably extending and contracting second telescoping member, one end portion secured to the second upper bracket on the second frame side and the other end portion adjustably positioned and secured to a selected aperture on the second brace side of the generally U-shaped brace member, a bottom portion of the second telescoping member extending beneath the second brace side of the generally U-shaped brace member;

d) a high strength polymeric woven fabric sized to fit in spaced relation within the fabric support frame, the woven fabric having a plurality of grommets extending in spaced relation about the outer periphery of the woven fabric; and e) a plurality of springs secured at one end to the grommets in the outer periphery of the woven fabric, and secured at the opposite end to the fabric support frame, to provide a resilient woven fabric resiliently supported within a fabric support frame which may be adjustably positioned in relation to the ground to selectively provide rebounds simulating ground balls, line drives and fly balls.

2. The rebound apparatus of claim 1, wherein at least one rod is secured to the opposite ends of the springs on at least one side of the fabric support frame, with bolts secured upon each of said rod(s) on at least one side of the fabric support frame, said bolts having a threaded end extending through apertures in one wall of the fabric support frame, with nuts threadably secured to the threaded bolt portion to adjustably tension the woven fabric within the fabric support frame.

3. The rebound apparatus of claim 1, wherein the woven fabric is a high strength, high modulus polymeric woven fabric having a fabric count of at least 40 by 30 strands per square inch, a finished square yard weight of at least 6 ounces, and a grab tensile strength of at least 400×300 pounds.

4. The rebound apparatus of claim 3, wherein the woven fabric is a polypropylene woven fabric having a fabric count of 60×50 strands per square inch, a finished square yard weight of 7.9 ounces, and a grab tensile strength of 475×415 pounds.

5. The rebound apparatus of claim 1, wherein the grommets positioned about the outer periphery of the woven fabric are spaced from one inch to six inches apart.

6. The rebound apparatus of claim 1, wherein at least one wheel is rotatably secured to the bottom frame side of the fabric support frame, for ease of transport.

7. The rebound apparatus of claim 1, wherein the bottom portion of the first and second frame sides, and the bottom portion of the first and second telescoping members are each capped with a resilient material.

8. The rebound apparatus of claim 7, wherein indicia is adjustably positioned and releasably secured to the woven fabric with a hook and loop type fastening means.

9. The rebound apparatus of claim 1, wherein the first and second lower brackets are secured from one to seven inches from the respective first and second bottom portions of the fabric support frame.

10. The rebound apparatus of claim 1, wherein the number of bolts secured to a selected rod are less than the number of springs secured to said selected rod.

11. The rebound apparatus of claim 1, wherein the U-shaped brace member may be folded in substantially parallel alignment with the fabric support frame, and the first and second telescoping members may be folded in substantially parallel alignment with the fabric support frame and releasably secured to an aligned aperture in the U-shaped brace member, for ease of transport and storage.

12. The rebound apparatus of claim 1, wherein said U-shaped brace member may be folded in substantially parallel alignment with the fabric support frame, and said first and second telescoping members may be substantially folded in parallel alignment with the fabric support frame and secured to an aligned aperture in the U-shaped brace member, for ease of transport and storage.

13. A rebound apparatus, comprising:

a) a fabric support frame having a first frame side, a top frame side, a second frame side and a bottom frame side, said first frame side having a first bottom portion extending below the bottom frame side, a first lower bracket and a first upper bracket secured to said first frame side, said second frame side having a second bottom portion extending below the bottom frame side in alignment with said first bottom portion, a second lower bracket and a second upper bracket secured to said second frame side in alignment with respective said first lower bracket and said first upper bracket;

b) a generally U-shaped brace member having a first brace side, a back brace side, and a second brace side, the distal end of said first brace side being pivotally secured to said first bottom bracket secured to said first frame side, and the distal end of said second brace side being pivotally secured to said second bottom bracket secured to said second frame side, said first and second sides of said U-shaped brace member having a plurality of spaced apertures therein sized to receive a removable fastening means therein;

c) an adjustably secured extending and contracting first telescoping member, a top end portion of said first telescoping member pivotally secured to said first upper bracket on said first frame side, and a bottom end portion of said first telescoping member pivotally secured to a selected aperture on said first brace side of said U-shaped brace member, said bottom end portion of said first telescoping member extending beneath said first brace side of the U-shaped brace member, and an adjustably secured extending and contracting second telescoping member, a top end portion of said second telescoping member pivotally secured to said second upper bracket on said second frame side, and a bottom end portion of said second telescoping member pivotally secured to a selected aperture on said second brace side of said U-shaped brace member, said bottom end portion of said second telescoping member extending beneath said second brace side of said U-shaped brace member in alignment with the bottom end portion of said first telescoping member, said first and second telescoping members each having a plurality of apertures therein sized to receive said removable fastening means therein;

d) a polymeric woven fabric sized to fit in spaced relation within said fabric support frame, said woven fabric having a fabric count of at least 40×30 strands per square inch, a finished square yard weight of at least six ounces, and a grab tensile strength of at least 400×300 pounds, said woven fabric having a plurality of grommets extending in spaced relation selected from one to seven inches apart about the outer periphery of the woven fabric;

e) a plurality of springs secured at one end to said grommets, said springs secured at the opposite end to said fabric support frame on a selected one of said first and second frame sides, and to said fabric support frame on a selected one of said top frame side and said bottom frame side, a first rod extending along the unselected one of the first and second frame sides for securement of the opposite end of said plurality of springs extending on the unselected one of the first and second frame sides, and a second rod extending along the unselected one of said top frame side and said bottom frame side for securement of the opposite end of said plurality of springs extending on the unselected one of said top frame side and said bottom frame side, a plurality of bolts having a rod securing end and a threaded end, the rod securing end secured to one of said first and second rods, the threaded end passing through a selected one of a plurality of apertures in the fabric support frame, the plurality of bolts being less in number than the plurality of springs on respective said first and second rods, and a plurality of nuts threadably secured to said threaded ends of said bolts to adjustably tension the spring members to selectively adjust the resiliency of said rebound apparatus; and f) said first and second telescoping members are adjustably and releasably secured and adjustably positioned to provide rebounds selected from ground balls, line drives and fly balls.

14. The rebound apparatus of claim 13, wherein at least one wheel is rotatably secured to the bottom frame side of the fabric support frame, for ease of transport.

15. The rebound apparatus of claim 13, wherein the bottom portion of said first and second frame sides, and the bottom portion of said first and second telescoping members are each capped with a resilient material.

16. The rebound apparatus of claim 13, wherein indicia is adjustably positioned and releasably secured to the woven fabric with hook and loop type fasteners.

17. The rebound apparatus of claim 13, wherein said first and second lower brackets are secured from one to seven inches from respective first and second bottom portions of said fabric support frame.

18. A rebound apparatus, comprising:

a) a fabric support frame having a first frame side, a top frame side, a second frame side and a bottom frame side, said first frame side having a first bottom portion extending below the bottom frame side, a first lower bracket and a first upper bracket secured to said first frame side, said second frame side having a second bottom portion extending below the bottom frame side in alignment with said first bottom portion, a second lower bracket and a second upper bracket secured to said second frame side in alignment with respective said first lower bracket and said first upper bracket, said first and second lower brackets secured from one to seven inches from the respective first and second bottom portions of the fabric support frame;

b) a generally U-shaped brace member having a first brace side, a back brace side, and a second brace side, the distal end of said first brace side being pivotally secured to said first bottom bracket secured to said first frame side, and the distal end of said second brace side being pivotally secured to said second bottom bracket secured to said second frame side, said first and second sides of said U-shaped brace member having a plurality of spaced apertures therein sized to receive a removable fastening means therein;

c) an adjustably secured extending and contracting first telescoping member, a top end portion of said first telescoping member pivotally secured to said first upper bracket on said first frame side, and a bottom end portion of said first telescoping member pivotally secured to a selected aperture on said first brace side of said U-shaped brace member, said bottom end portion of said first telescoping member extending beneath said first brace side of the U-shaped brace member, and an adjustably secured extending and contracting second telescoping member, a top end portion of said second telescoping member pivotally secured to said second upper bracket on said second frame side, and a bottom end portion of said second telescoping member pivotally secured to a selected aperture on said second brace side of said U-shaped brace member, said bottom end portion of said second telescoping member extending beneath said second brace side of said U-shaped brace member in alignment with the bottom end portion of said first telescoping member, said first and second telescoping members each having a plurality of apertures therein sized to receive said removable fastening means therein;

d) a polymeric woven fabric sized to fit in spaced relation within said fabric support frame, said woven fabric having a fabric count of at least 40×30 strands per square inch, a finished square yard weight of at least six ounces, and a grab tensile strength of at least 400×300 pounds, said woven fabric having a plurality of grommets extending in spaced relation selected from one to seven inches apart about the outer periphery of the woven fabric;

e) a plurality of springs secured at one end to said grommets, said springs secured at the opposite end to said fabric support frame on a selected one of said first and second frame sides, and to said fabric support frame on a selected one of said top frame side and said bottom frame side, a first rod extending along the unselected one of the first and second frame sides for securement of the opposite end of said plurality of springs extending on the unselected one of the first and second frame sides, and a second rod extending along the unselected one of said top frame side and said bottom frame side for securement of the opposite end of said plurality of springs extending on the unselected one of said top frame side and said bottom frame side, a plurality of bolts having a rod securing end and a threaded end, the rod securing end secured to one of said first and second rods, the threaded end passing through a selected one of a plurality of apertures in the fabric support frame, the plurality of bolts being less in number than the plurality of springs on respective said first and second rods, and a plurality of nuts threadably secured to said threaded ends of said bolts to adjustably tension the spring members to selectively adjust the resiliency of said rebound apparatus; and f) said first and second telescoping members are adjustably and releasably secured and adjustably positioned to provide rebounds selected from ground balls, line drives and fly balls, wherein the U-shaped brace member may be folded in substantially parallel alignment with the fabric support frame, and the first and second telescoping members may be folded in substantially parallel alignment with the fabric support frame and releasably secured to an aligned aperture in the U-shaped brace member, for ease of transport and storage.

19. The rebound apparatus of claim 13, wherein at least one wheel is rotatably secured to said bottom frame side of said fabric support frame, for ease of transport.

20. The rebound apparatus of claim 13, wherein indicia is adjustably positioned and releasably secured to the woven fabric with hook and loop type fastening means.

* * * * *